US005592808A

United States Patent [19]

Brunner et al.

[11] Patent Number: 5,592,808

[45] Date of Patent: Jan. 14, 1997

[54] OPENER DEVICE FOR A SPINNING STATION OF AN OPEN-END SPINNING MACHINE

[75] Inventors: Armin Brunner, Lärchenstrasse; Erich Bock, Rosenstrasse, both of Germany

[73] Assignee: Rieter Ingolstadt Spinnereimaschinenbau AG, Ingolstadt, Germany

[21] Appl. No.: 451,047

[22] Filed: May 25, 1995

[30] Foreign Application Priority Data

Aug. 4, 1994 [DE] Germany ..... 44 27 584.6

[51] Int. Cl.[6] ..... D01H 4/00; D01H 13/14

[52] U.S. Cl. ..... 57/408; 57/78; 57/105; 57/406; 57/407; 57/412

[58] Field of Search ..... 57/406, 407, 408, 57/409, 410, 411, 412, 413, 105, 78

[56] References Cited

U.S. PATENT DOCUMENTS

| | | | |
|---|---|---|---|
| 3,802,176 | 4/1974 | Stahlecker | 57/406 X |
| 3,807,158 | 4/1974 | Landwehrkamp et al. | 57/408 X |
| 3,874,154 | 4/1975 | Stahlecker et al. | 57/407 |
| 3,884,027 | 5/1975 | Schumann et al. | 57/301 |
| 4,059,947 | 11/1977 | Stahlecker | 57/407 |
| 4,069,655 | 1/1978 | Stahlecker et al. | 57/407 |
| 4,753,067 | 6/1988 | Landwehrkamp et al. | 57/406 X |

FOREIGN PATENT DOCUMENTS

| | | | |
|---|---|---|---|
| 2115484 | 10/1972 | Germany | 57/407 |
| 2323511 | 11/1974 | Germany . | |
| 4219683 | 1/1993 | Germany | 57/406 |

*Primary Examiner*—William Stryjewski
*Attorney, Agent, or Firm*—Dority & Manning

[57] ABSTRACT

An opener device in an open-end spinning machine includes an opener roller driven by a drive disk and a drive belt. A tension roller is movable between a first position wherein it exerts a driving tension force on the drive belt, and a second position wherein the tension roller exerts a lesser tension on the drive belt so that the drive belt can be removed from the device. A braking device includes a movable actuating element and a braking belt contacting member, such as a bolt, associated with the actuating element so as to be moved thereby. The actuating element and braking belt contacting member are movable between a first position wherein the braking belt contacting member is at a distance from the drive belt and a second position wherein the braking belt contacting member comes into the contact with the drive belt forcing the belt away from the drive disk.

16 Claims, 6 Drawing Sheets

OPENER DEVICE FOR A SPINNING STATION OF AN OPEN-END SPINNING MACHINE

BACKGROUND OF THE INVENTION

The present invention relates to the opener device of a spinning station of an open-end spinning machine, as well as to a device for the installation of a drive belt. DE-A 22 00 686 discloses an opener device which is assigned to a spinning station of an open-end spinning machine. The opener device has as its essential component an opener roller which is installed in a swivelling cover of the open-end spinning device. During maintenance of the spinning station this cover is opened whereby the opener roller is pressed with its drive wharve against a stationary brake when the swivelling movement is sufficiently wide and is thus braked. It is also provided for the tension roller of the belt drive of the opener roller to be pressed against a fixed component of the opener device by the swivelling motion and for the opener roller to be thus braked. The belt is then clampingly held between the tension roller and a fixed stop. The disadvantage of this device is that in case of wear on the wharve of the drive roller, the braking action is relatively weak, and that in the other case damage and wear on the drive belt and on the tension roller is possible. In both embodiments, it is a further disadvantage that the drive belt remains in the area of the drive disk, so that when the drive belt is replaced great care must be taken. The drive disk which continues to rotate represents a danger to the operating personnel with such a design of the device.

DE-A 21 1 619 discloses an embodiment of an opener device in which the opener roller is also driven by means of a belt drive. To brake the opener roller, the tension roller together with the driving belt is moved away from the drive disk, whereby a trunk of the belt presses against a braking edge which is rigidly attached to the spinning station. The disadvantage of the opener device described here is the fact that the device requires much space. Replacement of the drive belt is difficult because it cannot be relaxed. Furthermore, a tension roller that can be swivelled in this manner is very expensive.

Depending on the wear of the opener roller and of the drive belt and due to the replacement of the opening roller when processing a different output material at the spinning station, it is necessary to stop the opener roller in order to replace the above-mentioned components of the opener device. Furthermore, it is necessary that the opener device may be inspected without danger for maintenance purposes. In the state of the art provisions are made to stop the opener roller automatically through the opening of the cover of the spinning station. It is important here that no danger threaten the operating personnel here, not only during operation, but also during inspection and maintenance of the opener device. In the first place, it is necessary that the opener device be designed so that it can be stopped reliably and quickly. Endangerment by the other components of the opener device should also be kept as low as possible.

OBJECTS AND SUMMARY OF THE INVENTION

It is a principal object of the present invention to propose an opener device for a spinning station of an open-end spinning machine which avoids the disadvantages of the state of the art, by means of which the opener roller can be braked safely and quickly, and which is therefore considerably more maintenance-friendly and maintenance-safe.

Another object of the present invention is to propose a device for the installation of a drive belt of an opening device of an open-end spinning machine by means of which the maintenance of the opener device, in particular also the replacement of the drive belt on the opener device, can be carried out rapidly and above all safely by the operator.

Additional objects and advantages of the invention will be set forth in part in the following description, or may be obvious from the following description, or may be learned through practice of the invention.

The design of the opener device according to the invention makes it possible to stop the opener roller reliably and rapidly. Coasting of the opener roller after actuating the actuating element to stop the opener roller is only so brief that the opener roller has stopped before the operator can reach the opener roller. When the braking bolt intervenes into the running of the drive belt, the belt can be put under further tension so that a better braking action is made possible by avoiding belt slip. Furthermore, it is especially advantageous to push the pulling trunk of the drive belt back against its empty trunk, so that an especially good braking effect is achieved. During braking, the drive belt is lifted from the drive disk and the drive disk is simultaneously advantageously covered in part by the braking bolt so that when a worn drive belt is replaced, the new drive belt can be laid around the tension roller without risk that the operator will come into contact with the drive disk. Braking bolts are understood to be not only a bolt-shaped element within the framework of this invention, but also any suitable element, e.g. also a bent piece of sheet metal, an angular or ball shaped element, or a component of any other shape which can be moved towards the drive belt and is able to influence it in the sense of the invention. It is also possible to use a braking bolt supporting a roller and which presses against the drive belt with this roller. The braking action would thus be produced practically only by the rubbing of the two belt halves against each other. It is especially advantageous if the braking bolt is moved to the drive belt in the area between the drive disk and tension roller, because thereby the drive belt can be lifted quickly from the tension roller and the braking bolt is better able to cover the tension roller to prevent unintentionally touching it.

The further advantageous design of the invention makes it possible to relax the drive belt easily, so that it can be easily lifted from the drive wharve of the opener roller and can be controlled, or can simply be replaced in case of wear. This is possible without danger to the operator. To relax the drive belt, it is not necessary to reach within range of the rotating parts. Furthermore, the intervention to replace the opener roller can be done from the normal operator side of the spinning station, from which the spinning rotor is also accessible, for example. An intervention from the back of the spinning machine or from below the spinning machine is not necessary for this. The danger of over-stretching the drive belt does not exist either, since the tension roller need not be pulled over the belt in the relaxing direction but is controlled by means of the actuating element of the opener device according to the invention. In this process the drive belt is held by braking bolts and tension roller in position at the spinning roller, so that following the replacement of the opener roller, the belt is ready to be applied to the wharve of the new opener roller. When the drive belt is replaced, the newly installed belt is held on the tension roller as soon as it is laid on it, so that the further assembly steps can be carried out without danger that the drive belt may again slide from the drive roller. In this case the drive disk is advantageously covered by the braking bolt, since the braking bolt intervenes into the course of the drive belt between the tension roller and the drive disk.

It is especially advantageous if the braking bolt is installed on a deflection lever, since it can be supported precisely in this manner and the swivelling motion of the braking bolt can be coordinated precisely with the movement of the actuating element. It is advantageous to install the deflection lever on the tension roller support so that it is rotatable, because the movement of the braking bolt and of the tension roll are thereby automatically coordinated with each other. It is especially advantageous for the actuating element to attack at the deflection lever, because the arrangement can thereby be provided with an advantageous lever for the actuation of the braking bolt, whereby the connection is best made rotatable. It is especially advantageous for the opener device to be provided with a cover and for the latter to control the actuating element because this ensures that the opener roller is stopped automatically during maintenance of the opener device. Danger to the operating personnel is thereby totally excluded.

The tension element proposed is advantageously a spring which bears advantageously upon the tension roller support. It is especially advantageous for the tension element to attack at the deflection lever. In this manner the force of the tension element can easily be reduced from the operating position so that a load decrease on the drive belt is possible without great expenditure of force. The design of the actuating element in the form of an actuating lever has the special advantage that, not only traction, but also thrust forces can be transmitted. The rotatability of the deflection lever is advantageously limited by a stop, because thereby a precise geometric attribution of braking bolt, tension roller, and drive disk is ensured, in particular in a braking position. Preferably the opener device is designed so that the pivot point of the actuating element is located on the deflection lever and its center of motion on the tension roll support in braking position so that they are aligned substantially on one line. In this manner the opener device is especially simple in design. The relief of the belt from tension with special economy of force is possible if the tension element attacks at the deflection lever. It is especially advantageous to equip the opener device with a retainer for the positioning of a device for the installation of a drive belt. This makes it possible that auxiliary means can be connected to the opener device for the installation of the drive belt in order to render maintenance of the opener device safer and quicker.

The device according to the invention for the installation of a drive belt has the advantage that the drive belt is received by the device, so that the drive belt can be handled more easily. The drive belt is presented to the operator so that the installation can be carried out quickly, and above all without danger. The drive belt can in this case be removed step by step from the device. The belt is held securely between the different assembly steps. The device is especially advantageous if it has a positioning device. Thereby it can be put in exact position at the opener device so that the belt is presented precisely where it is needed to be installed. It is a further advantage that precise positioning makes it possible to cover up danger spots on the opener device with the device for the installation of the drive belt, so that during maintenance of the opener device there is no danger for the operating personnel. It is thus possible to cover the drive disk for the drive belt of the opener roller in such a manner that contact with the hand is practically impossible. At the same time, the handling of the drive belt is facilitated to such an extent that no special training is required to insert the belt. This means that even an untrained person is able to carry out the maintenance of the opener device without danger. It is especially advantageous to provide the device with an enclosed hollow space since it receives the drive belt securely and grasps the belt securely during the introduction of the device into the opener device. Thanks to the described, advantageous dimensions of the hollow space it is possible for the drive belt to be received securely and to be removed again easily to be installed in the opener device. Making the length of the hollow space of the device advantageously one half of the length of the drive belt makes it possible for the belt to be received over its entire length and for the device to advantageously have a length such that the drive disk can be covered by the device. This advantageous design of the device makes it possible to cover points of the belt drive which may be dangerous to the operating personnel. One half length of the drive belt is to be understood to be the dimension of one half of the circumference of a belt laid out into a circle. The especially advantageous design of the positioning device in the form of a stop makes it possible for the device to bear upon the wharve of the opener roller, so that the device can be introduced into the opener device, with no additional room needed for this, other than the space which must be available for the drive belt itself. The advantageous design of the stop in the form of an elastic clamp makes it possible for the device not only to be positioned but also to be fixed in the opener device during the installation of the belt. A further development of the device, with an opening to take out the drive belt at the end of the device which is turned towards the tension roller during the installation of the drive belt, makes it possible for the drive belt to be taken partially out of the device so that it can be placed next on the tension roller of the opener device. The remaining portion of the drive belt can then be taken out of the device in that the latter is pulled out of the opener device in the direction of the opener roller until the belt has left the device completely. In this state, the drive belt lies directly on the wharve of the drive roller on which it can then be installed by the operator.

The invention is described below through drawings.

DETAILED DESCRIPTION OF THE PREFERRED EMBODIMENTS

Figure 1:
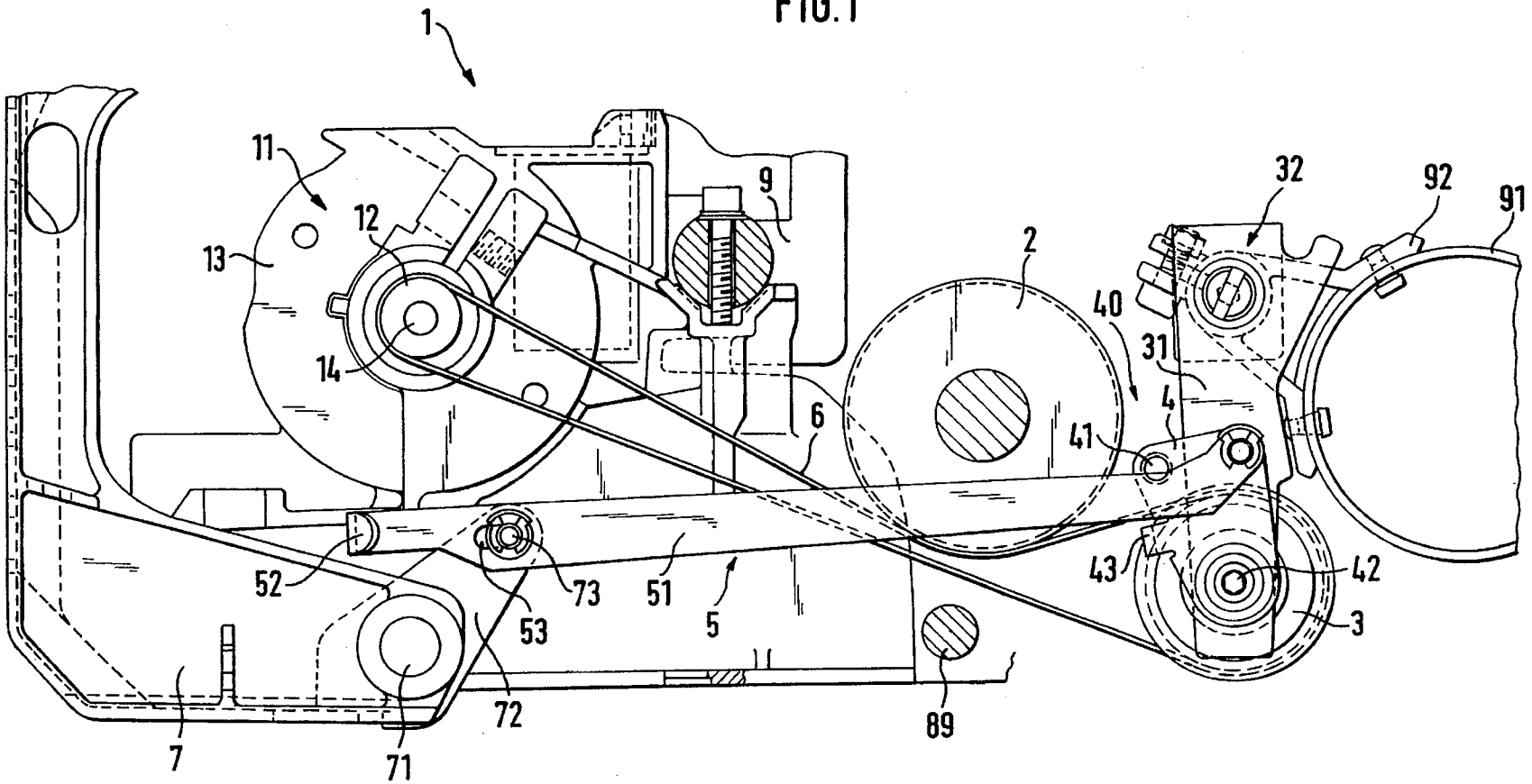
FIG. 1 shows a side view of an opener device in operating position, party in a section.

Reference will now be made in detail to the presently preferred embodiments of the invention, one or more examples of which are illustrated in the drawings. Each example is provided by way of explanation of the invention, and not meant as a limitation of the invention. In fact, various modifications and variations can be made in the invention without departing from the scope or spirit of the invention. Additionally, the numbering of components is consistent throughout the application, with the same components having the same number.

The opener device of FIG. 1 is part of a spinning box of an open-end rotor spinning machine. But it could just as well be part of an open-end friction spinning machine. The individual fibers are taken out of the presented sliver by the opener device 1 in a known manner and are conveyed by a pneumatic fiber conveying system to an open-end spinning rotor, for example. The opener roller is covered in a known manner with a clothing consisting of teeth or needles and is rotated rapidly by means of a drive arrangement. The opener device 1 consists essentially of an opener roller 11, a drive disk 2, a drive belt 6 and a tension roller 3. It is installed on the machine frame 9 of a spinning machine. The opener roller 11 is provided with a shaft 14 on which it is mounted and driven. To drive the unit, a wharve 12 is installed on the shaft via which the drive belt 6 drives the opener roller 11. The drive belt 6 is held via a tension roller 3 on the drive disk 2 which is rotated by the drive of the spinning machine. The tension roller 3 is rotatably mounted on a tension roller support 31 and is loaded by means of a tension element 32 in such a manner that it is able to keep the drive belt 6 under tension. The tension element 32 may comprise a torsion spring in the present case, pressing the tension roller 3 in the direction of the frame pipe 91. The tension roller support 31 is mounted on the latter via a support 92. FIG. 1 shows the opener device in operating position in which the drive belt 6 is in contact with the drive disk 2. The rotation of the drive disk 2 is therefore transmitted to the wharve 12 by means of the belt 6 so that the opener roller 11 rotates at several thousand rpm's in its housing 13. The opener device 1 is provided on its left side which is accessible by the machine operator with a cover 7 which can be swivelled around the pivot point 71. This cover 7 can cover not only the opener device 1 in a known manner but, as is normal with rotor spinning machines, also the area of the rotor bearing and of the spinning rotor. To stop the opener roller 11, the opener device 1 is equipped with a brake 40 which is provided with a braking bolt 41. The latter is attached to a deflection lever 4 which is in turn mounted so as to be rotatable around the axis 42 on the tension roller support 31. The swivelling motion of the deflection lever 4 is delimited by the stop 43. In the final position of the swivelling motion of the deflection lever 4, the stop 43 presses against the tension roller support 31. To actuate the braking bolt 41, the deflection lever 4 is connected to an actuating element 5. The latter is made in the form of an actuating lever 51 which is rotatably attached to the deflection lever 4 by its one end. At its other end it is connected to the cover 7. The cover 7 is provided with a lever 72 which has a bolt 73. The bolt 73 enters into an oblong opening 53 of the actuating lever 51. For the manual actuation of the actuating lever 51, the latter is provided with a handle 52 at its end away from the tension roller.

Figure 2A:
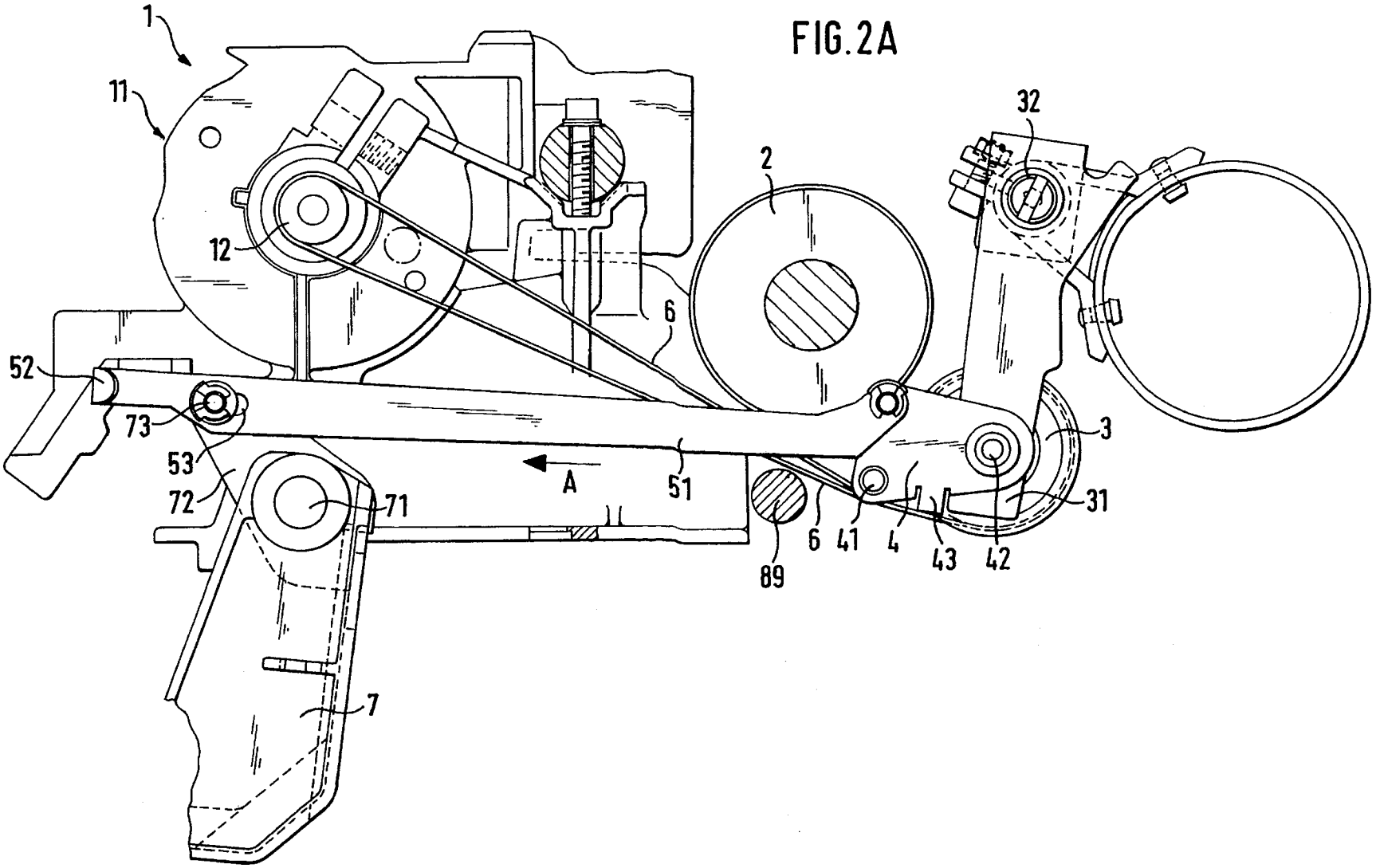
FIG. 2*a* shows the opener device of FIG. 1 in the braked position.

FIG. 2*a* shows the opener device 1 of FIG. 1 with an open cover 7. Through rotation around the pivot point 71 executed by the cover 7 as it is swivelled, the lever 72 has also been swivelled around pivot point 71. As a result, the position of the bolt 73 has also changed in the direction away from the tension roller. Due to the limited mobility of the bolt 73 in the oblong opening 53 of the actuating lever 51, the latter has also moved to the left, so that the deflection lever 4 has been swivelled around its pivot point, i.e. axis 42. The braking bolt 41 is pressed on the drive belt 6 by this swivelling movement of the deflection lever 4 so that the drive belt 6 was lifted off from the drive disk 2. The latter is therefore no longer in contact with the drive belt 6. The swivelling movement of the deflection lever 4 is limited by the contact of the stop 43 against the tension roller support 31. The braking bolt 41 has come down on the drive belt 6 so that the empty trunk and the pulling trunk of the drive belt 6 touch each other in the area of the braking bolt 41. The braking action is thus not only produced by friction between the braking bolt 41 and the drive belt 6 but also by the friction of the drive belt 6 against itself. In the position shown in FIG. 2 the drive belt 6 continues to be held under tension by the tension roller 3, so that the drive belt 6 cannot slide off of the wharve 12 of the opener roller 11. The opener roller 11 is braked quickly and securely and is brought to a stop. When the cover 7 is being closed, the deflection lever 4 swivels back into the starting position shown in FIG. 1 so that the drive belt 6 is again brought into contact with the drive disk 2. The rotation of the drive disk 2 is transmitted via drive belt 2 to the wharve 12 of the opener roller 11 which is thereby caused to rotate again. The stop 43 ensures that the deflection lever 4 always swivels around axis 42 when the actuating lever 51 moves in the opposite direction arrow A in such manner that the braking bolt 41 is lifted up.

When the machine operator or the maintenance personnel opens the cover 7, the opener roller is stopped automatically so that no danger exists from a still rotating opener roller. After opening of the cover, the opener roller cannot only be inspected but can also be replaced. For this it is necessary to take the drive belt off the wharve of the opener roller. This is done especially easily and safely with the opener device according to FIGS. 1 and 2 because when the cover is open, the drive belt 6 can easily be relaxed by hand by the maintenance person. For this purpose the actuating lever 51 is provided with a handle 52. Upon grasping the handle 52, the maintenance person can pull the actuating lever 51 in the direction of the arrow A until the right end of the oblong opening 53 presses against the bolt 73. This causes the tension roller 3 to be swivelled in the direction of the opener roller, so that the drive belt 6 loses its tension and can easily be pulled from the wharve. The tension element 32, which is a torsion spring in this case, is designed so that it makes the additional movement of the tension roller 3 possible. When the drive belt 6 has been lifted from the wharve 12, the handle 52 of the actuating lever 51 can be released again so that the tension roller 3 swivels back into the position shown in FIG. 2. The bolt 73 is in this position again in contact with the left end of the oblong opening 53. The drive belt 6 remains practically unchanged in the area of the tension roller 3 because it moves down, under the effect of gravity, in the direction of the swivelled cover 7 after being removed from the wharve. At the same time it bears however on the retainer 89 so that the latter, together with the braking bolt 41, holds the drive belt 6 in the opener device 1. When the opener roller 11 has been replaced, the maintenance person can grasp the drive belt hanging below the wharve and, when the actuating lever 51 has again been pulled in the direction of arrow A, can lay the drive belt 6, which is not under tension in this operation, again around the wharve 12 of the opener roller. The actuating lever 51 is then released again so that the tension roller 3 puts the drive belt 6 under tension. During the subsequent closing of the cover 7, the opener roller 11 is again rotated in a known manner. The length of the oblong opening 53 is selected so that the actuating lever 51 can be pulled by the operator only so far in the direction of arrow A that the drive belt 6 is relaxed and can easily be removed from the wharve 12, and on the other hand that the tension roller 3 is not moved too far in the direction of the drive disk 2.

Figure 2B:
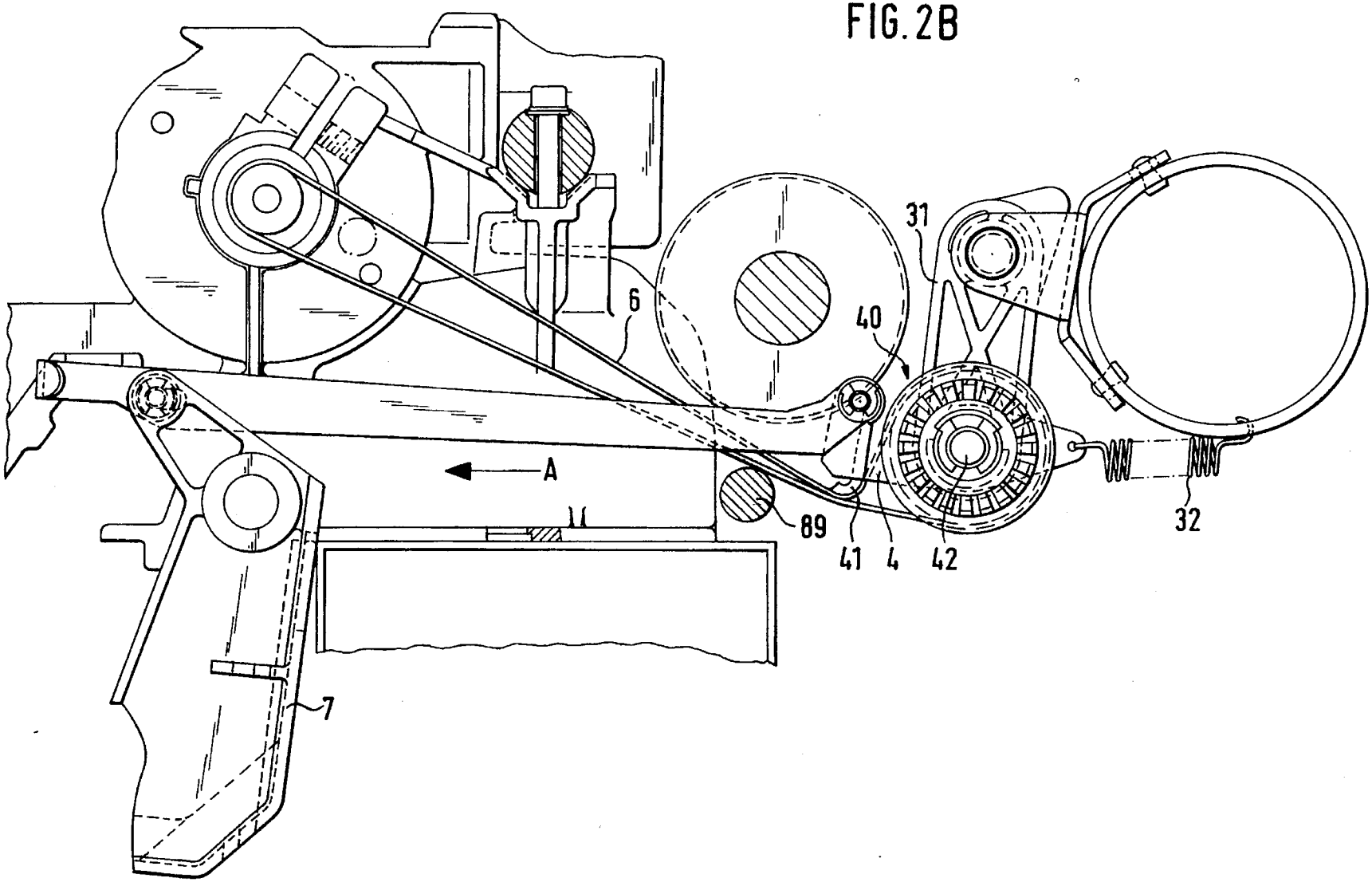
FIG. 2*b* shows a similar opener device with a deflection lever of different design.

FIG. 2*b* shows a similar brake 40 as FIG. 2*a*, and also in braking position. Here however, the tension element 32 is in the form of a tension spring. The latter does not attack at the tension roller support 31 but at the deflection lever 4. The latter is rotatable around axis 42, as in FIG. 2*a*, and is thus connected to the tension roller support. The braking bolt 41 is made in the form of a hook in this embodiment.

In closing the cover 7, this is not done as in the description of FIG. 2*a*, with the assistance of the tension element 32, but against the force of the tension spring. As the actuating lever 51 moves in the direction opposite to arrow A, the deflection lever 4 is rotated in a clockwise direction, so that the tension spring is further tensed. During the operation of the opener device 1 the same tension force is exerted on the drive belt as in FIG. 2*a*. In operation the actuating lever 51 is here however under pressure, since the deflection lever 4 bears on the actuating lever 51. This embodiment of the invention has the advantage that in order to release the drive belt 6 by the operator by using handle 52, less force is needed than in the embodiment of FIG. 2*a*. since the drive belt of FIG. 2*b* has a lower tension during braking. This must be compensated for through other measures. In the present case the loop around the braking bolt is larger and furthermore the drive belt bears upon retainer 89.

Figure 3:
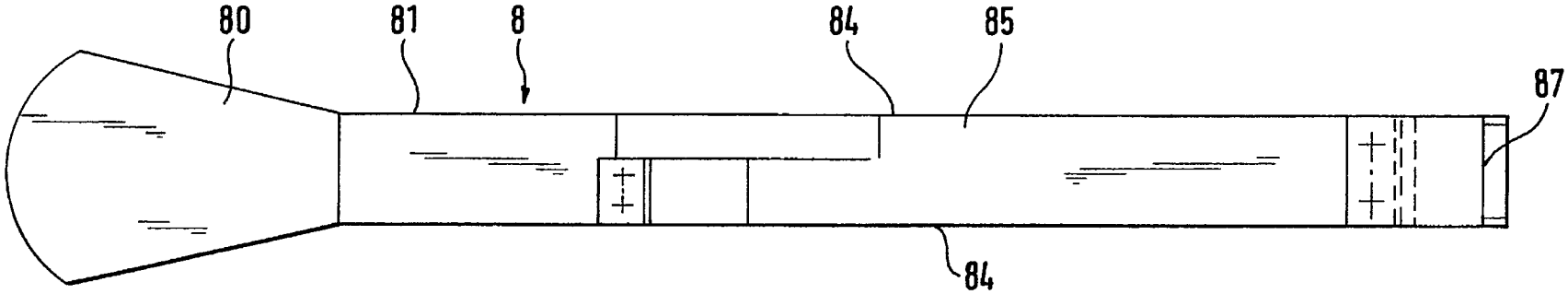
FIG. 3 shows a device for the installation of a drive belt for an opener deice in a top view.
Figure 4:
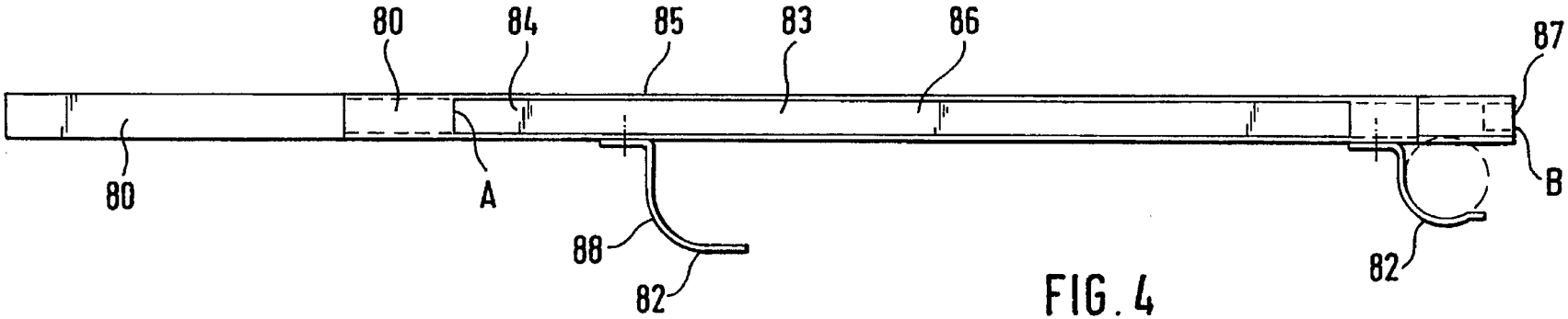
FIG. 4 shows the device of FIG. 3 in a side view.
Figure 5:
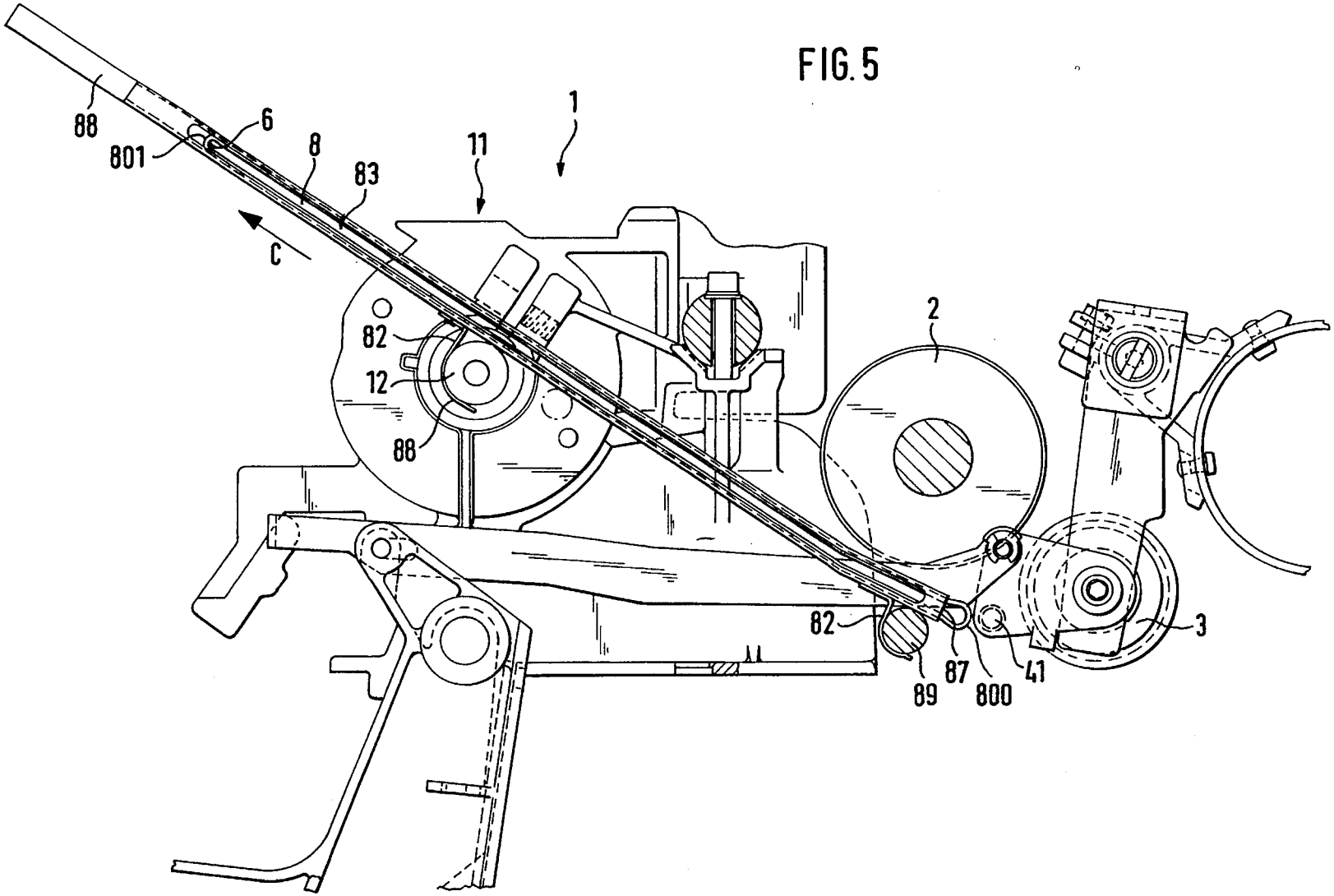
FIG. 5 shows a device similar to FIGS. 3 and 4 installed in an opener device.

FIGS. 3 and 4 show a device 8 for the installation of a drive belt in a top view and in a side view. The device 8 consists essentially of a basic body 81 and of the devices 82 for the positioning of device 8. For better handling, a handle 80 is attached to the device 8. The base body 81 consists here of a thin sheet metal, but other materials can also be used. The device has two narrow sides 84 and two wide sides 85, which together enclose a hollow space 83. This hollow space 83 has a height, measured from one of the wide sides 85 to the other wide side 85 which is approximately double the thickness of the drive belt which is to be installed by means of this device in an opener device. The width of the hollow space 83, measured from one narrow side 84 to the other narrow side 84 has approximately the same value as the width of the drive belt to be installed. The length of the device 8, measured between sides A and B has approximately the value of one half length of the drive belt. It is however also possible for this length to be slightly shorter, so that the drive belt peeks out in the form of a loop from opening 87 for taking out the drive belt. The belt is introduced into the hollow space 83 of the device 8 through opening 86 which is produced in that at least part of one of the two narrow sides is missing. For the introduction into the hollow space 83, the drive belt is pressed flat and the two belt segments laying on top of each other are then pushed sideways into the opening. The device 8 can be positioned in the opener device at the proper location by means of at least one device 82 for the positioning of same. The present embodiment shown in FIGS. 3 to 5 is equipped with two positioning devices 82, of which one is a stop 88 which interacts with the wharve of the opener roller on which the belt is to be installed. Both devices 82 are elastic clamps which attach themselves clampingly on a retainer for the positioning of the device 8 on the opener device. This fixes the device 8 and the maintenance personnel has both hands free to handle the drive belt. Device 8 has an opening 87 of the hollow space 83 from which the drive belt located in said hollow space 83 can be taken.

FIG. 5 shows a device 8 for the installation of a drive belt, installed in an opener device 1. The device 82 for the positioning of the device 8 located near the handle 80 engages the wharve 12 of the opener roller 11. The other device 82 for the positioning of the device 8 engages the retainer 89 of the opener device 1. The drive belt extends in the form of a loop 800 from the opening 87 through which it is to be taken out. When the device 8 has been installed in the opener device 1 it remains securely in its position due to the elastic configuration of stop 88 which surrounds the wharve 12 and due to the elastic configuration of the device 82 which surrounds the retainer 89. The operator is therefore able to take the loop 800 of the drive belt 6 out of the opening 87 and to lay it around the tension roller 3. When this has been done, the major portion of the drive belt 6 still remains in the hollow space 83 of the device 8 and is held securely by the latter. The operator is therefore able to grasp the device 8 by its handle 80 without any time pressure and to pull it out of the opener device 1 in the direction of arrow C. Thereby the remainder of the drive belt 6 leaves the hollow space 83 to the extent to which the device 8 is pulled in the direction of arrow C. Shortly before leaving the hollow space 83 the drive belt 6 can be grasped by the operator and applied immediately on the wharve 12, once the tension roller 3 has been swivelled in the direction of the opener roller by pulling on handle 52 of the actuating lever 51. Thereby the drive belt 6 can be applied to the wharve 12 without tension.

As can be clearly seen in FIG. 5, the drive disk 2 is covered towards the bottom by the device 8 so that the operator cannot come into contact with it. The device 8 can thus also serve as a protective cover of dangerous parts of the spinning machine. For this purpose it is then installed in the machine before the beginning of the maintenance tasks. These can then be carried out without danger. The advantageous presentation of the drive belt 6 by the device 8 has the advantage that the operator is able to apply the drive belt 6, without having to hurry, around the tension roller below the braking bolt 41 on tension roller 3. There is no danger that the drive belt 6 may get out of control since it remains for the entire time in the hollow space 83 of the device 8 and is held there. Due to the tension exerted by the loop 801 in proximity of handle 80 upon the inner side of the hollow space 83, the drive belt 6 fixes itself. The force with which the drive belt 6 is held in the device 8 can therefore be set through the height of the hollow space 83. Different heights of the hollow space 83 over the length over which the loop 801 is pulled out can even be adjusted for different take-out positions determining different take-out forces for the drive belt 6. As FIG. 5 clearly shows, the device 8 showed therein has a slight bend near the drive disk 2 so that the opening 87 may be positioned at the optimal location for the operator. In other embodiments of opener devices the device 8, in order to adjust it optimally for the current opener device, may be either completely straight or can be provided with one or several bends. This presents no problem, in particular in the bending direction of the installed drive belt.

Figure 6:
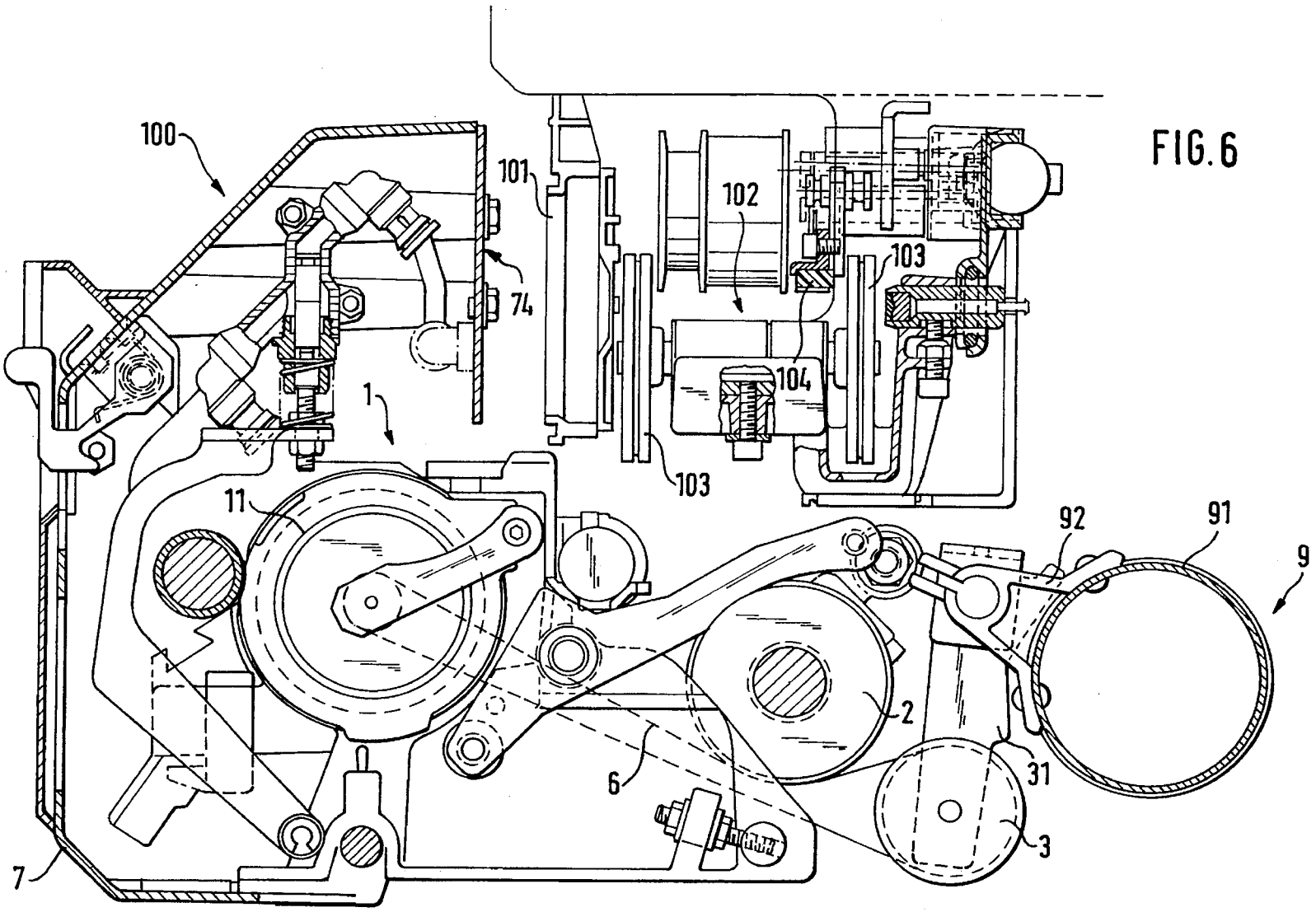
FIG. 6 shows a section through a spinning station of an open-end rotor spinning machine.

FIG. 6 shows a section through a spinning box 100 of an open-end rotor spinning machine. From this drawing the relation of the opener device 1 to the other components clearly appears. The opener device 1 shown here does not have a brake; it is only a schematic drawing to explain the function of cover 7. In addition to the previously mentioned components of the opener device 1, such as opener roller 11, drive disk 2, drive belt 6, tension roller 3 which is attached via tension roller support 31 and support 92 to the frame pipe 91 of the machine frame 9 and cover 7, the spinning box 100 consists of additional known components. These are the rotor housing 101, which is shown here without the rotor cover attached to cover 7, and the rotor bearing 102 with its supporting rings 103. The rotor cover which covers the rotor housing 101 is attached to the inner portion 74 of the cover 7. When the cover 7 is swivelled away, the rotor cover is thus removed from the rotor housing 101, whereby the brake 104 is applied a known manner (not shown here) to the shaft of the spinning rotor. The different brakes (brake 104, brake 40 of the opener device) in the spinning box can be put into operation in this case simultaneously or consecutively and with different opening settings of cover 7.

It will be apparent to those skilled in the art that various modifications and variations can be made in the present invention without departing from the scope or spirit of the invention. For instance, features described or illustrated as part of one embodiment can be used on another embodiment to yield a still further embodiment. It is intended that the present invention cover such modifications and variations as come within the scope of the appended claims and their equivalents.

We claim:

1. An opener device for use in an open-end spinning machine, comprising:

an opener roller rotatably driven by a driven drive disc through a drive belt;

a tension roller, said drive belt disposed about said tension roller; and a braking device for braking said opener roller; said braking device further comprising a movable actuating element and a braking member operably associated with said actuating element so that a movement of said actuating element moves said braking member;

said actuating element and braking member movable between a first position wherein said braking member is at a distance from said drive belt and a second position wherein said braking member is in contact with said drive belt forcing said drive belt away from said drive disk.

2. The device as in claim 1, wherein said braking member comprises a rigid bolt mechanism.

3. The device as in claim 1, wherein said braking member is disposed to contact said drive belt between said drive disk and said tension roller.

4. The device as in claim 1, further comprising a tension roller support mechanism supporting said tension roller, said actuating element in operable communication with said tension roller support mechanism and movable to a third position for moving said tension roller to its said second position.

5. The device as in claim 1, further comprising a pivotal deflection lever operably configured with said actuating element so as to be moved thereby, said braking member disposed on said deflection lever.

6. The device as in claim 5, further comprising a tension roller support mechanism supporting said tension roller, said deflection lever pivotally connected to said tension roller support mechanism.

7. The device as in claim 6, wherein said actuating element is connected to said deflection lever so that movement of said actuating element causes said deflection lever to pivot relative said tension roller support mechanism with said braking member coming into contact with said belt, and wherein upon further movement of said actuating element said tension roller is moved to its said second position.

8. The device as in claim 6, further comprising a stop mechanism disposed so as to limit movement of said deflection lever.

9. The device as in claim 1, further comprising an openable cover member disposed in front of at least said opener roller, said actuating element connected to said cover wherein upon an operator opening said cover said actuating element is moved causing said braking member to come into contact with said drive belt.

10. The device as in claim 1, further comprising a tensioning element operably connected to said tension roller for applying a tensioning force to said tension roller.

11. The device as in claim 10, wherein said tensioning element comprises a spring.

12. The device as in claim 10, further comprising a tension roller support mechanism supporting said tension roller, said tensioning element connected to said tension roller support mechanism.

13. The device as in claim 12, further comprising a pivotal deflection lever operably connected to said actuating element so as to be moved thereby and pivotally connected to said tension roller support mechanism, said tensioning element connected to said deflection lever.

14. The device as in claim 13, wherein connection points between said actuating element and said deflection lever and between said deflection lever and said tension roller support mechanism are disposed so as to lie substantially in a straight line when said braking device is actuated and said drive belt is moved away from said drive disc.

15. The device as in claim 1, wherein said actuating element comprises a lever mechanism.

16. The device as in claim 1, further comprising a stationary retainer element disposed so as to receive and position a belt replacing tool for drive belt replacement.

* * * * *